United States Patent [19]

Röck

[11] Patent Number: 4,953,991

[45] Date of Patent: Sep. 4, 1990

[54] PULL-OUT GUIDE ASSEMBLY FOR DRAWERS

[75] Inventor: Erich Röck, Höchst, Austria

[73] Assignee: Julius Blum Gesellschaft m.b.H., Höchst, Austria

[21] Appl. No.: 458,371

[22] Filed: Dec. 28, 1989

[30] Foreign Application Priority Data

Jan. 9, 1989 [AT] Austria ..... A 30/89

[51] Int. Cl.[5] ..... F16C 29/00

[52] U.S. Cl. ..... 384/19; 384/22

[58] Field of Search ..... 384/19, 21, 22, 51, 384/17, 18; 312/450

[56] References Cited

U.S. PATENT DOCUMENTS

| | | | |
|---|---|---|---|
| 4,212,503 | 7/1980 | Litchfield et al. | 384/21 |
| 4,423,914 | 1/1984 | Vander Ley | 384/19 |
| 4,690,571 | 9/1987 | Fulterer | 384/22 |
| 4,692,035 | 9/1987 | Röck et al. | 384/21 |

*Primary Examiner*—Lenard A. Footland

*Attorney, Agent, or Firm*—Wenderoth, Lind & Ponack

[57] ABSTRACT

A pull-out guide assembly for drawers in which there is arranged, on each side of the drawer, a pull-out rail on the side of the drawer and a supporting rail on the side of the body. Slides or rollers which are for example mounted in a carriage are mounted between the rails. The supporting rails are in longitudinal direction divided into a mounting member fastenable to the furniture side wall and a running member. The mounting member is adapted to be coupled to the running member. A horizontal flange of the running member is at the rear end pushed below a hook which is bent out from a horizontal flange of the mounting member. A positioning pin for the running member is provided at the front end of the supporting rail. The positioning pin has the form of a hook. A slide is mounted at the mounting member and presses the running member towards the rear in the push-in direction of the drawer and underneath the projection of the positioning pin.

5 Claims, 4 Drawing Sheets

7
5
5
9
8
10

7
5
4
5
4
9
8
10

7
4
4
15
14
12
8
10
8

PULL-OUT GUIDE ASSEMBLY FOR DRAWERS

FIELD AND BACKGROUND OF THE INVENTION

The invention relates to a pull-out guide assembly for drawers or the like in which there are provided, on each side of the drawer, a pull-out rail on the side of the drawer and a supporting rail on the side of the body, and load-transmitting slides or rollers mounted in a carriage, for example, the supporting rails in longitudinal direction being divided into a mounting member fastenable to the furniture side wall and a running member, and the mounting member being adapted to be coupled to the running member, a horizontal flange of the running member being at the rear end pushed below a hook bent out from a horizontal flange of the mounting member, and at the front end of the supporting rail a positioning pin for the running member being provided.

Pull-out guide assemblies of the afore-mentioned kind should in a furniture body make pulling out and pushing in of the drawers as smooth as possible, and furthermore they should hold a drawer which has been partly extracted from the furniture body in the body, in particular when the drawer has been extracted from the furniture body more than half of its depth.

According to the state of the art, such pull-out guide assemblies are provided either with slides or rollers. Pull-out guide assemblies are also known in which the rollers are mounted in separate carriages.

In general, pieces of furniture are transported to the customers in disassembled condition and assembled on the place where they are required. This is particularly the case with kitchen assemblies or the like.

AT-PS No. 332 034 describes a T-shaped guide rail for drawers which is snugly fittable into a plastics guide rail. The rail is together with a carriage arranged in a groove of the drawer side wall. This arrangement prevents the rollers from falling out from the guide rails, when the drawer is in the extracted position.

DE-OS No. 27 21 451 describes a body rail which comprises two parts and is also arranged at the level of the drawer side wall.

The two mentioned arrangements do not facilitate mounting of the piece of furniture.

SUMMARY OF THE INVENTION

It is the object of the invention to provide a pull-out guide assembly of the kind mentioned in the introduction to this specification in which as many parts as possible should be promountable, that is at the body side wall as well as at the drawer, furthermore stacking and packing of the parts of the pull-out guide assembly should be relatively easy, and quick assembling of the piece of furniture should be possible, preferably even without tools. Moreover, it should be possible to mount a major part of the pull-out guide assembly at the drawer before the piece of furniture is assembled. It is a particular object of the invention to provide a fast and releasable coupling for the mounting members and the running members. According to the invention this is achieved in that the positioning pins are hooks, and that a slide which is mounted in the mounting member presses the running member in the push-in direction of the drawer towards the rear and underneath the projection of the positioning pin.

By means of the embodiment according to the invention, the unity comprising running member, carriage and pull-out rail which is mounted at the drawer below the drawer bottom and directly beside the side wall can, when the drawer is inserted into the furniture body, be fitted onto the mounting member and secured against unintentional lifting therefrom by means of the slide.

It is advantageously provided that the slide is pressed into the locking position by means of a spring.

It is further advantageously provided that the slide is mounted below the horizontal flange of the mounting member.

A further embodiment of the invention provides that the slide has a handle member which forms at the same time a stop for the running member.

BRIEF DESCRIPTION OF THE FIGURES OF THE DRAWING

In the following an embodiment of the invention will be described in more detail with reference to the figures of the drawing without limiting the invention thereto, in which.

Figure 1:
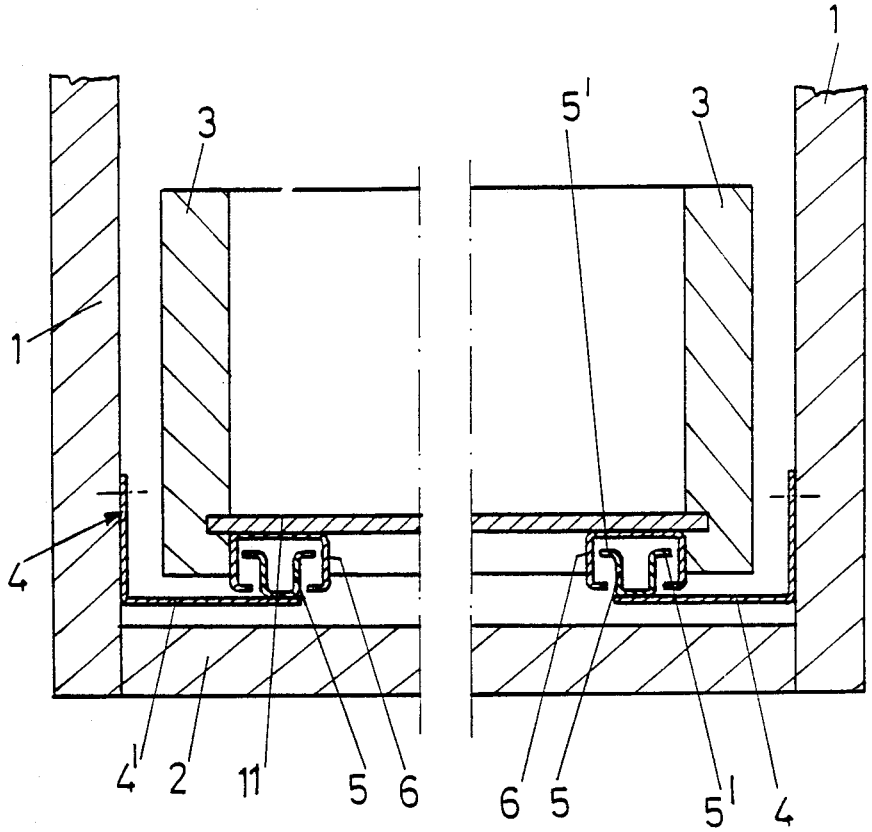
FIG. 1 shows a diagrammatic cross-sectional view of a drawer and a furniture body with a pull-out guide assembly according to the invention.
Figure 2:
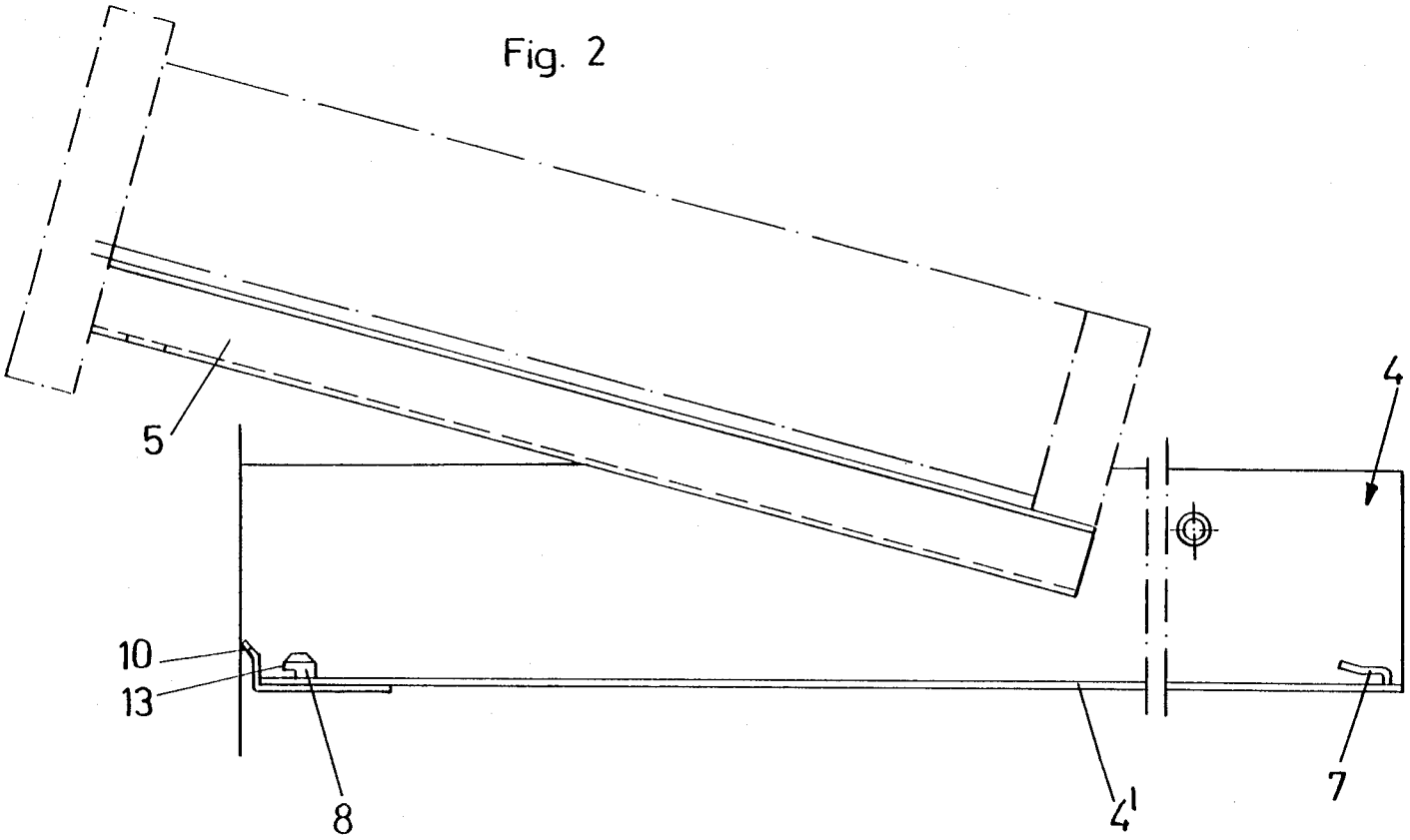
FIG. 2 shows a side view of the pull-out guide assembly, the drawer being shown in the disengaged position.
Figure 3:
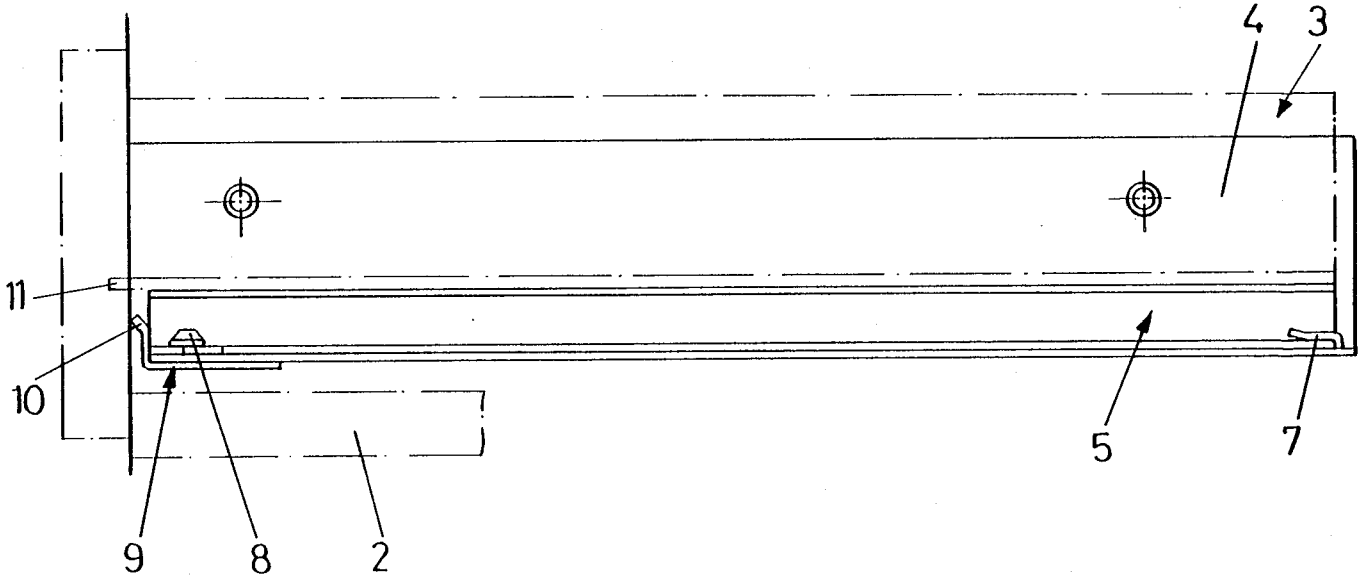
FIG. 3 shows an identical view with the drawer being engaged.

In the figures of the drawing, the two side walls of the drawer are designated with reference number 3 and the drawer bottom with 11.

The side walls of the furniture body are designated with reference number 1 and the bottom of the body with 2.

DESCRIPTION OF THE PREFERRED EMBODIMENTS

A pull-out rail 6 is fastened on each side underneath the drawer, that is on the inner side in respect of the drawer side walls 3.

The mounting members 4, which are of angular shape, as shown in FIG. 1, are fastened to the two side walls 1, advantageously they are screwed to the side walls 1. A running member 5 is mounted on the horizontal flange 4' of each mounting member 4.

Depending on the requirements, rollers or slides are mounted between the pull-out rail 6 and the running member 5. Said rollers or slides are not shown in the illustrated embodiments because the actual running system of the pull-out guide assembly is not subject of the present invention.

A hook 7 is bent from the horizontal flange 4' of each mounting member 4. At the front end, the mounting member 4 is provided with a positioning pin 8. The positioning pin 8 has a forwardly extending projection 13.

A slide 9 is mounted below the horizontal flange 4' at the front end of each mounting member 4. The slide 9 has a handle member 10 which also serves as a stop for the running member 5.

Figures 4, 5, 6:
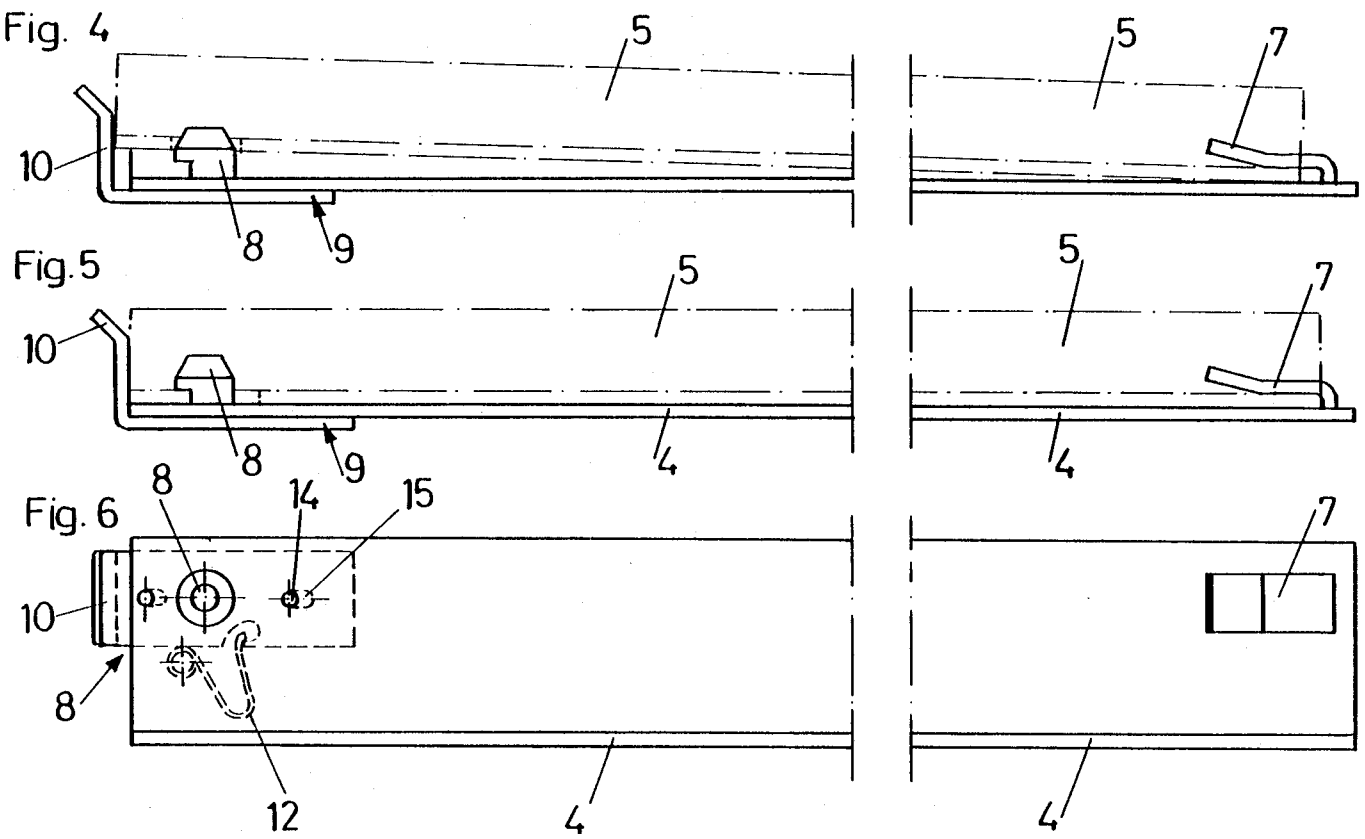
FIG. 4 shows a side view of the supporting member and of the running member during the engaging operation.
FIG. 5 shows a side view of the supporting member and of the running member with the running member being engaged.
FIG. 6 shows a top view of the mounting member.

As can be seen from FIG. 6, the slide 9 can be acted upon by a spring 12 which presses the slide 9 towards the rear in the push-in direction of the drawer. In this arrangement, the slide 9 is advantageously mounted on bolts 14 which extend through slots 15 in the slide 9.

Fitting of the running member 5 onto the mounting member 4 can paricularly be seen from FIGS. 4 and 5. First, the slide 9 is in its front position, that is the handle member 10 is spaced from the front edge of the mounting member 4. The running member 5 which is by means of the rollers held in the pull-out rail 6 is at the rear pushed underneath hook 7 and at the front fitted onto positioning pin 8. Then, the slide 9 is either by hand or by the force of spring 12 pushed towards the rear and thus presses running member 5 also towards the rear.

By means of the projection 13 of the positioning pin 8, the running member 5 is secured against unintentional lifting from mounting member 4.

What is claimed is:

1. A pull-out guide assembly for drawers, comprising, on each side of the drawer, a pull-out rail on the side of the drawer and a supporting rail on the side of the body, and load-transmitting slides or rollers mounted in a carriage, the supporting rails in longitudinal direction being divided into a mounting member fastenable to the furniture side wall and a running member, and the mounting member being adapted to be coupled to the running member, a horizontal flange of the running member being at the rear end pushed below a hook bent out from a horizontal flange of the mounting member, and at the front end of the supporting rail a positioning pin for the running member being provided, characterized in that said positioning pin is a hook, and that a slide is mounted at said mounting member, said slide pressing said running member in the push-in direction of the drawer towards the rear end and underneath a projection of said positioning pin.

2. A pull-out guide assembly as claimed in claim 1, characterized in that said slide is pressed into the locking position by means of a spring.

3. A pull-out guide assembly as claimed in claim 1, characterized in that said slide is mounted below said horizontal flange of said mounting member.

4. A pull-out guide assembly for drawers as claimed in claim 1, characterized in that said slide comprises a handle member which also forms a stop for said running member.

5. A pull-out guide assembly as claimed in claim 1, characterized in that said running member has a U-profile with outwardly projecting marginal flanges.

* * * * *